US005896580A

United States Patent [19]

Aldrich et al.

[11] Patent Number: 5,896,580

[45] Date of Patent: Apr. 27, 1999

[54] MULTI-LAYER KNEE PAD CONSTRUCTION

[76] Inventors: Frederick W. Aldrich; John J. Germanoro, both of 36A Kern St., Collingdale, Pa. 19023

[21] Appl. No.: 09/169,763

[22] Filed: Oct. 9, 1998

[51] Int. Cl.[6] ..... A41D 13/00

[52] U.S. Cl. ..... 2/24; 2/22; 2/267

[58] Field of Search ..... 2/22, 23, 24, 911, 2/62, 267, 231

[56] References Cited

U.S. PATENT DOCUMENTS

| | | | |
|---|---|---|---|
| 4,561,124 | 12/1985 | Thompson | 2/23 |
| 4,619,055 | 10/1986 | Davidson . | |
| 4,831,666 | 5/1989 | Denman | 2/23 |
| 4,920,577 | 5/1990 | Scharf | 2/24 |
| 5,052,052 | 10/1991 | Gilford et al. | 2/23 |
| 5,134,726 | 8/1992 | Ross | 2/23 |
| 5,361,410 | 11/1994 | Sigl | 2/23 |
| 5,365,610 | 11/1994 | Lubahn et al. | 2/23 |
| 5,592,689 | 1/1997 | Matthews | 2/23 |
| 5,625,895 | 5/1997 | Sovereign | 2/23 |
| 5,628,063 | 5/1997 | Reed | 2/23 |

*Primary Examiner*—John J. Calvert
*Assistant Examiner*—Gary L. Welch
*Attorney, Agent, or Firm*—Henderson & Sturm

[57] ABSTRACT

A multi-layer knee pad construction 10 for attachment to the interior surface 102 of the knee portion 101 of a pair of pants 100. The construction 10 includes an outer waterproof layer 11, an inner low friction layer 13 and an intermediate padded layer 12 operatively connected to one another and the interior surface 102 of the pair of pants by a plurality bonding layers 14.

3 Claims, 2 Drawing Sheets

MULTI-LAYER KNEE PAD CONSTRUCTION

REFERENCE TO MICROFICHE APPENDIX

Not applicable.

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to the field of protective padding devices in general, and in particular to a multi-layer knee pad construction.

2. Description of Related Art

As can be seen by reference to the following U.S. Pat. Nos. 4,831,666; 4,920,577; 5,134,726; and 5,592,689, the prior art is replete with myriad and diverse protective knee pad constructions.

While all of the aforementioned prior art constructions are more than adequate for the basic purpose and function for which they have been specifically designed, they are uniformly deficient with respect to their failure to provide a simple, efficient, and practical protective knee pad construction that can be ironed onto the interior knee portion of a pair of pants to provide a low profile waterproof, cushioned knee pad construction.

As any gardener, construction worker, or parent with small children is all too well aware, the presence of a protective knee covering is an absolute necessity under virtually all circumstances.

As a consequence of the foregoing situation, there has existed a longstanding need for a new and improved type of knee pad construction that employs a multi-layer construction that is waterproof, cushioned, and low friction, and the provision of such a construction is a stated objective of the present invention.

BRIEF SUMMARY OF THE INVENTION

Briefly stated, the multi-layered knee pad construction that forms the basis of the present invention comprises in general a waterproof layer, a padded layer, and a low friction layer which are all operatively engaged relative to one another by a plurality of bonding layers.

As will be explained in greater detail further on in the specification, the waterproof layer comprises a sheet of neoprene rubber which is not only waterproof, but also adds a degree of cushioned resiliency to the overall construction.

Furthermore, the padded layer comprises a sheet of fleece material and the low friction layer comprises a sheet of low friction cloth material that is intended to be in direct contact with the user's skin.

As a consequence of the foregoing arrangement, the knee pad construction is not visible to the casual observer, yet offers the user a low friction padded and waterproof protective device that is far superior to that provided by the prior art constructions.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
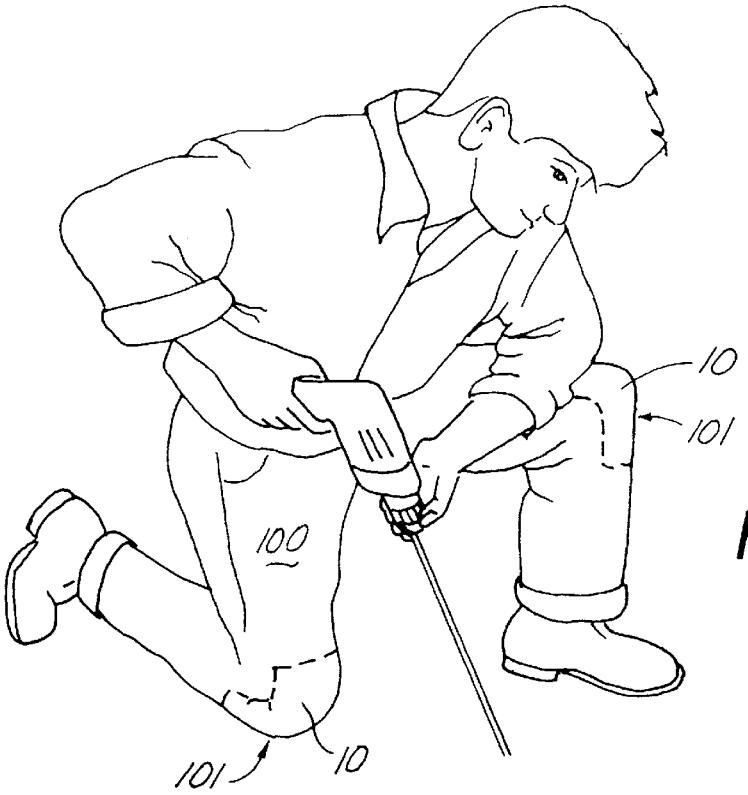
FIG. 1 is a perspective view of the knee pad construction of this invention in use.
Figure 3:
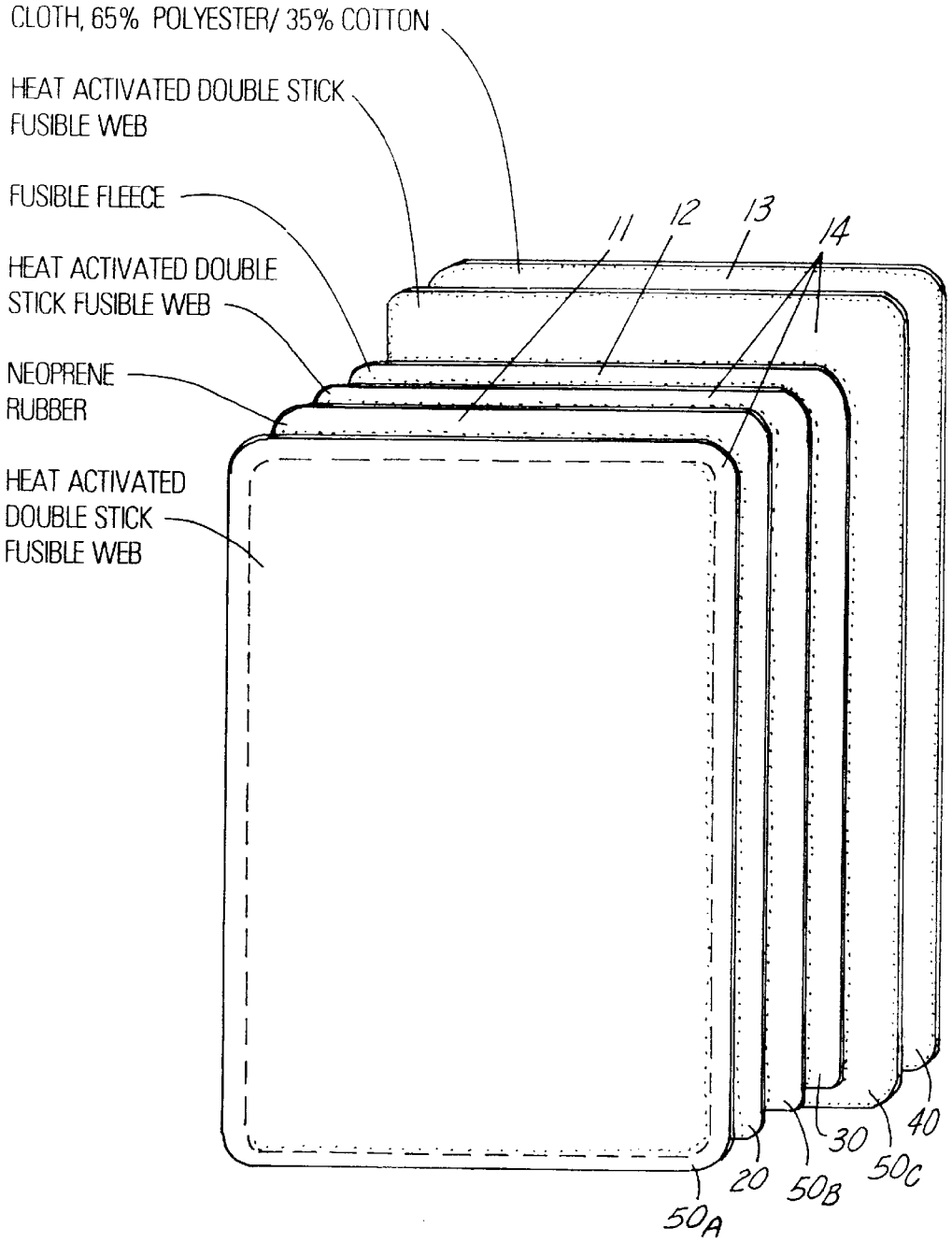
FIG. 3 is an exploded perspective view of the various layers that comprise the multi-layer knee pad construction.

As can be seen by reference to the drawings, and in particularly to FIG. 1, the multi-layer knee pad construction that forms the basis of the present invention is designated generally by the reference number 10. As shown in FIG. 3, the construction 10 comprises in general, an outer waterproof layer 11, an intermediate padded layer 12, an inner low friction layer 13, and a plurality of bonding layers 14.

As shown in FIG. 3, the waterproof layer 11 comprises a generally rectangular sheet of neoprene rubber material 20. The padded layer 12 comprises a generally rectangular sheet of fusible fleece material 30 and the low friction layer 13 comprises a generally rectangular sheet of low friction cloth material 40, such as a blend of 65% Polyester and 35% cotton. The neoprene rubber is not only a waterproof layer, but also due to its natural resilience also provides a degree of cushioning to the overall construction as will be explained further on in the specification.

Figure 2:
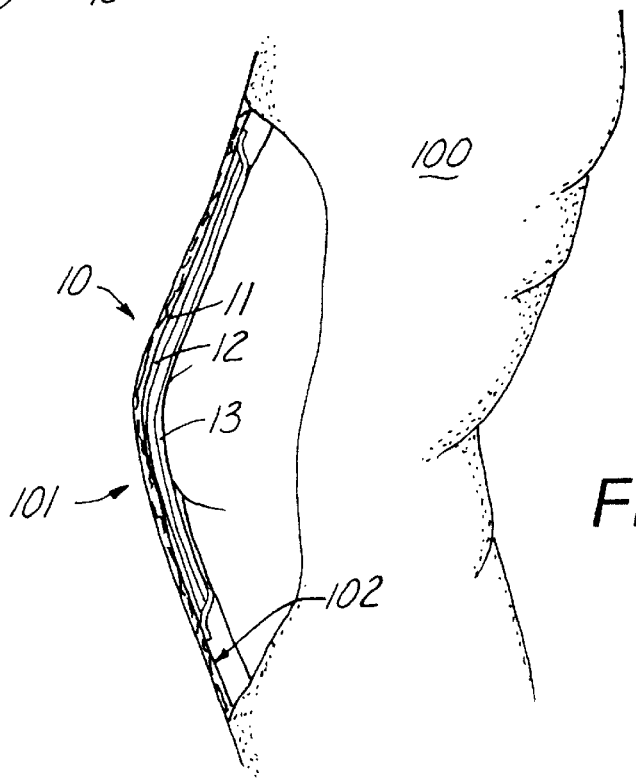
FIG. 2 is a partial cut away view of one leg of a pair of pants equipped with the multi-layer knee pad construction.

As can best be seen by reference to FIGS. 2 and 3, each of the plurality of bonding layers 14 comprise a generally rectangular sheet of double stick adhesive material 50 such as a fusible web. Furthermore, the first sheet of double stick adhesive material 50A is disposed intermediate the front of the waterproof layer 11 and the interior surface 102 of the knee portion 101 of a pair of pants 100. The second sheet of double stick adhesive material 50B is disposed intermediate the rear of the waterproof layer 11 and the front of the padded layer 12 to join those two layers 11 and 12 together. The third sheet of double stick adhesive material 50C is disposed intermediate the rear of the padded layer 12 and the front of the low friction layer 13 to join those layers together in a well recognized manner.

As can best be seen by reference to FIG. 3, both the inner low friction layer 13 and the third sheet of double stick adhesive material 50C are oversized to both cover the outer edges of the other layers 11 and 12 and further secure the construction 10 to the interior surface 102 of the user's pants 100.

As a consequence of the foregoing, the multi-layer construction places the waterproof layer 11 in direct contact with the interior surface 102 of the knee portion 101 of a pair of pants 100 such that any moisture deposited on the pant's knee 101 will be blocked from migrating through the construction 10 by the waterproof layer 11.

Furthermore, the resilience of the waterproof layer 11 compliments the cushioning effect of the padded layer 12 and the low friction layer 13 reduces the rubbing contact between the user's knee and the construction 10 to minimize abrasions and/or discomfort due to the presence of the construction 10 on the interior surface of the user's pants.

It should further be noted at this juncture that the installation of the construction 10 on the interior surface 102 of the user's pants 100 is not a mere matter of choice or element of design for the simple reason that the construction 10 is specifically intended to place a cushioned padded layer 12 having a low friction layer 13 in direct contact with the user's bare flesh, as opposed to having the generally coarse rugged high friction material of most work gardening, and children's play clothes be the cloth surface that is in direct contact with the bare flesh.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A multi-layer knee pad construction for attachment to the interior surface of the knee portion of a pair of pants wherein the construction comprises:

an outer waterproof layer comprising a sheet of neoprene rubber;

an inner low friction layer comprising a sheet of low friction cloth material;

an intermediate padded layer comprising a sheet of fleece material having opposite sides operatively associated with said outer layer and said inner layer;

first means for operatively connecting the outer waterproof layer to the interior knee portion of a pair of pants; and second means for operatively connecting the intermediate padded layer to both the outer waterproof layer and the inner low friction layer; wherein the first means and the second means comprise identical sheets of double stick adhesive material.

2. The construction as in claim 1 wherein the first and second means comprise respectively:

a first sheet of double stick adhesive material disposed on the front of the waterproof layer; and a second sheet of double stick adhesive material disposed intermediate the outer layer and the intermediate layer; and a third sheet of double stick adhesive material disposed intermediate the intermediate and the inner layer.

3. The construction as in claim 2 wherein said third sheet of double stick adhesive material and said inner layer are enlarged relative to said other layers and said first and second sheets of double stick adhesive material.

* * * * *